United States Patent [19]

Purcell

[11] 4,038,622

[45] July 26, 1977

[54] SUPERCONDUCTING DIPOLE ELECTROMAGNET

[75] Inventor: John R. Purcell, San Diego, Calif.

[73] Assignee: The United States of America as represented by the United States Energy Research and Development Administration, Washington, D.C.

[21] Appl. No.: 676,585

[22] Filed: Apr. 13, 1976

[51] Int. Cl.[2] ..... H01F 7/22

[52] U.S. Cl. ..... 335/216; 335/299

[58] Field of Search ..... 335/216, 299; 174/126 S

[56] References Cited

U.S. PATENT DOCUMENTS

| | | | |
|---|---|---|---|
| 3,626,341 | 12/1971 | Dao | 335/299 X |
| 3,731,241 | 5/1973 | Coupland | 335/216 X |
| 3,801,942 | 4/1974 | Elsel | 335/216 |

*Primary Examiner*—George Harris

*Attorney, Agent, or Firm*—Dean E. Carlson; Frank H. Jackson; Donald P. Reynolds

[57] ABSTRACT

A dipole electromagnet of especial use for bending beams in particle accelerators is wound to have high uniformity of magnetic field across a cross section and to decrease evenly to zero as the ends of the electromagnet are approached by disposing the superconducting filaments of the coil in the crescent-shaped nonoverlapping portions of two intersecting circles. Uniform decrease at the ends is achieved by causing the circles to overlap increasingly in the direction of the ends of the coil until the overlap is complete and the coil is terminated.

5 Claims, 10 Drawing Figures

SUPERCONDUCTING DIPOLE ELECTROMAGNET

CONTRACTUAL ORIGIN OF THE INVENTION

The invention described herein was made in the course of, or under, a contract with the UNITED STATES ENERGY RESEARCH AND DEVELOPMENT ADMINISTRATION.

BACKGROUND OF THE INVENTION

This invention relates to a method of constructing a dipole magnet with superconducting wire.

Dipole electromagnets are used in accelerators of charged particles to meet many needs. A magnetic field that increases in synchronism with the increasing acceleration of a charged particle is used in a synchrotron to maintain a constant orbit for particles that are being accelerated. Particles are injected into an accelerator along a path that is controlled by a dipole injection magnet. Acclerated particles are directed to desired locations by dipole bending magnets. The design of such magnets has heretofore been the subject of many computer studies to maintain a high degree of precision of the field in two ways. First, it is often desirable to have high uniformity of magnetic field across a cross section of the dipole magnet. This insures that particles anywhere within the field experience the same amount of bending for the same particle momentum. Second, it is often desirable that the magnetic field of the magnet fall uniformly to zero in an axial direction while maintaining equality of the fields across the cross section. This causes the magnet to bend but not to focus or defocus the beam.

Two basic approaches have been taken toward meeting the requirements described above in the construction of dipole electromagnets for particle accelerators. Almost all of the magnets thus far built for this purpose have used conventional electrical conductors and most of these have included iron cores to locate the magnetic fields in desired gaps. The first of these approaches has been to shape the pole faces of the iron cores to provide various gradients of magnetic fields in the gaps. For example, weak-focusing synchrotrons have gaps in accelerating dipole magnets that are substantially parallel. Magnets for strong-focusing synchrotrons typically have tapering gaps with the directions of the tapers altering from section to section. Either type of dipole magnet requires application of some form of focusing correction to the beam to make up for the effects of leaving the field of the dipole magnet. This may be accomplished by shaping the exit pole faces of the magnet or it may be accomplished by the installation of focusing magnets to make up for the defocusing effects that result from leaving an unshaped magnet. Both of these approaches involve considerable complexity in design and add control complications in the operation of the accelerators in which the magnets are used. In the case of the shaped ends of accelerating magnets in a weak-focusing synchrotron, the shape is of necessity a compromise between the terminations of the magnets that are desirable at low magnetic fields and those needed at high magnetic fields. In the case of strong-focusing synchrotrons, the focusing fields must be programmed to vary with the varying strength of the accelerator field during the ramp of each pulse. This adds extra magnets to be placed under the control of the accelerator control system and thus adds an extra complication.

It is an object of the present invention to provide a better dipole electromagnet for a particle accelerator.

It is a further object of the present invention to provide a superconducting dipole magnet with an air core.

It is a further object of the present invention to provide a superconducting magnet having spatially uniform decrease to zero of the magnetic field at the ends of the magnet and a uniform magnetic field along each cross section.

It is a further object of the present invention to provide a method of winding a better superconducting dipole magnet.

Other object will become apparent in the course of a detailed description of the invention.

SUMMARY OF THE INVENTION

A dipole electromagnet formed of superconducting wire is caused to have a magnetic field that is uniform across a cross section perpendicular to the axis of the magnet and that falls off uniformly to zero as a function of position approaching an end of the magnet. These effects are achieved by disposing the windings in the crescent-shaped areas defined by the interior of one, but not both, of a pair of intersecting circles of equal size. The termination at the end of the magnet is achieved by causing the areas containing wire to decrease to zero as though the centers of the defining circles were moved into coincidence.

BRIEF DESCRIPTION OF THE DRAWINGS

FIG. 3 is a partial sectional side view of the end of the magnet of FIG. 1 taken along section lines 3—3 of FIG. 1.

FIG. 5 is a sequence of sectional views of the end of the magnet of FIG. 1 as seen along section lines **5*a* through 5*e* of FIG. 1.**

DETAILED DESCRIPTION OF THE INVENTION

Figures 1, 5A, 5B, 5C, 5D, 5E:
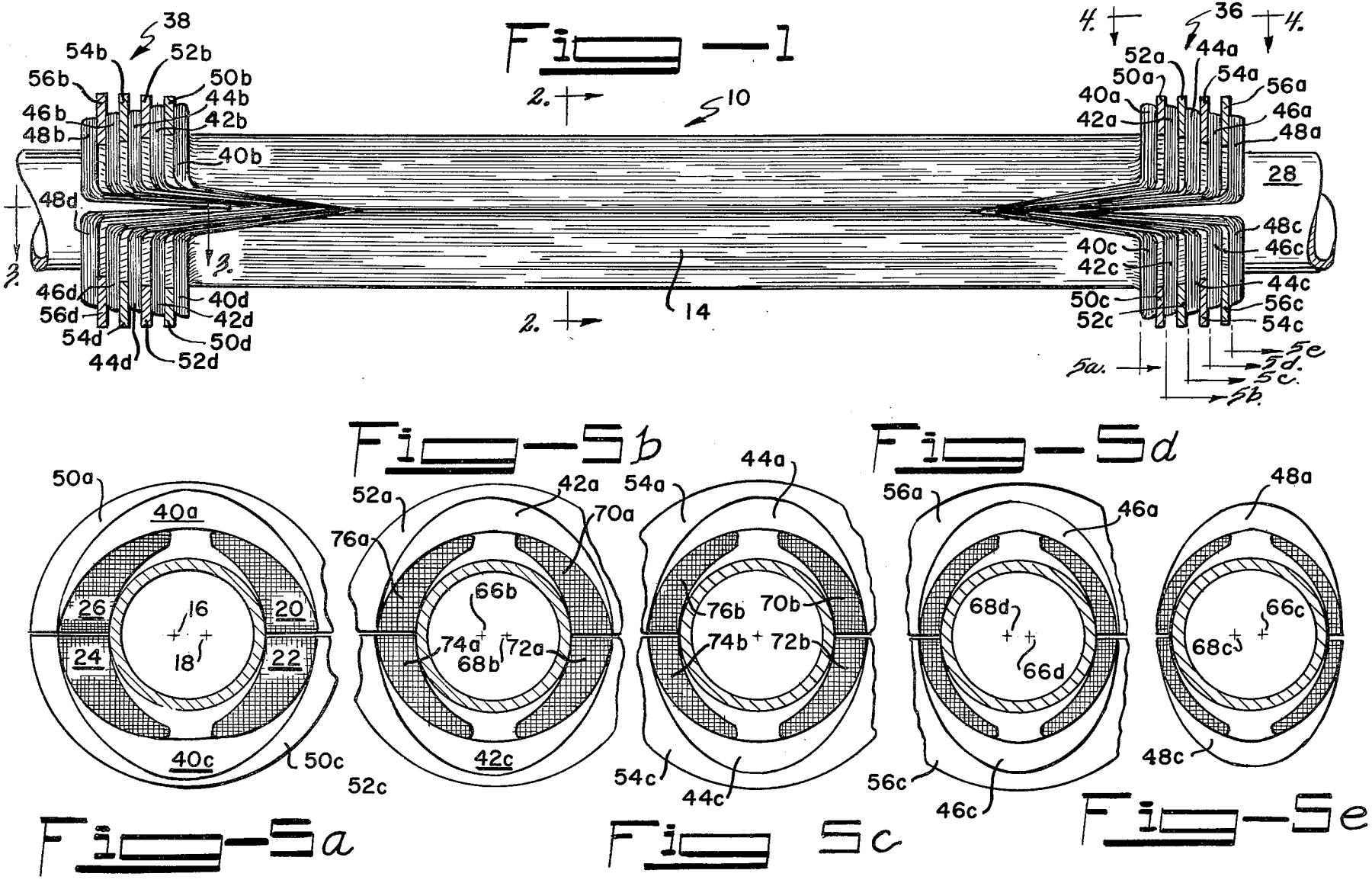
FIG. 1 is a side view of the superconducting magnet of the present invention.
Figure 2:
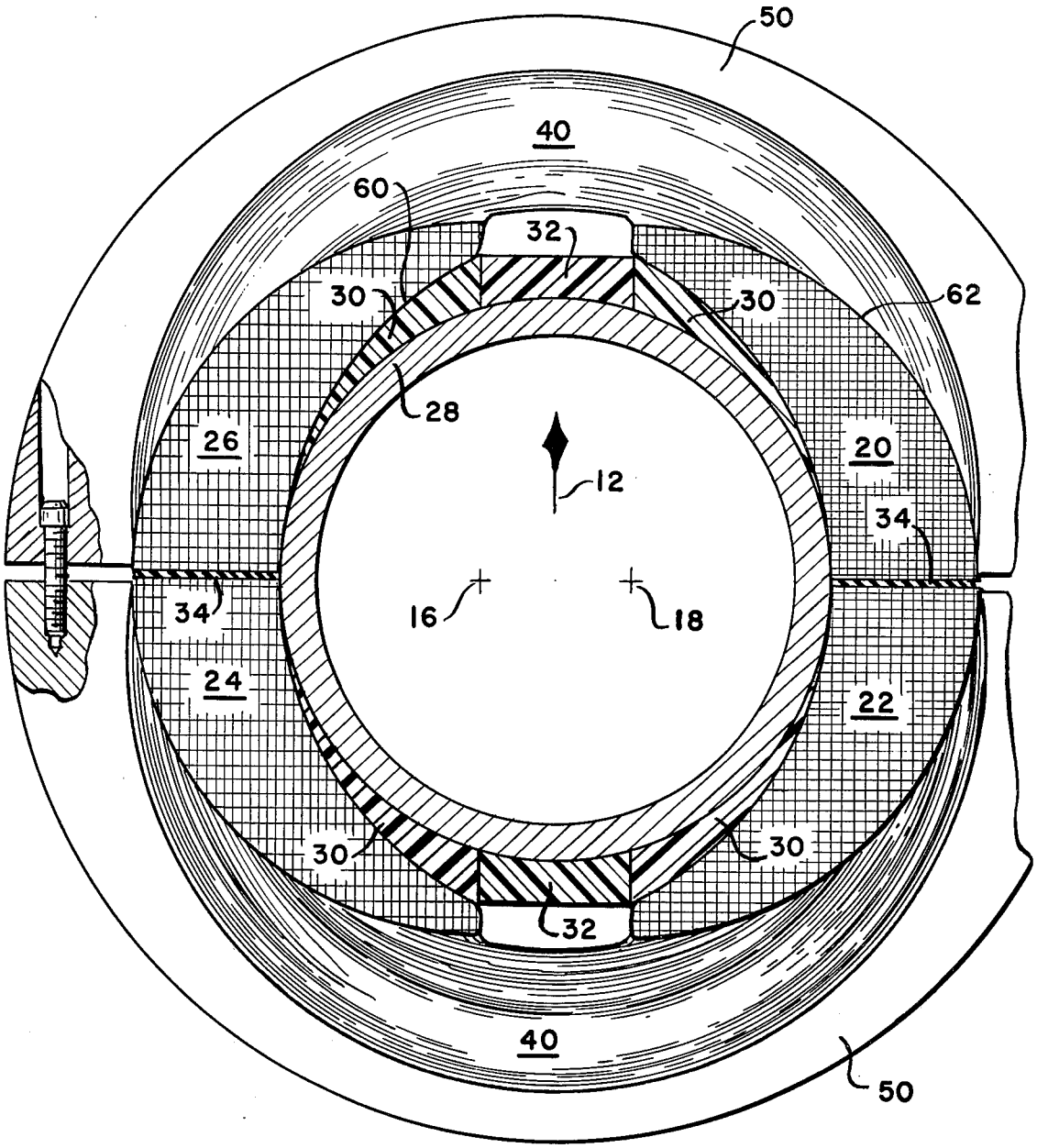
FIG. 2 is a sectional view of the magnet of FIG. 1 taken along section lines 2—2.

FIG. 1 is a side view of the superconducting dipole magnet of the present invention and FIG. 2 is a sectional view of the magnet of FIG. 1 taken along section lines 2—2 of FIG. 1. In FIG. 1, region 10 is a central region in which a uniform magnetic field is maintained as indicated by flux arrow 12 in FIG. 2. The magnetic field is set up by a flow of current in superconducting wires 14. Wires 14 extend through region 10 of FIG. 1 and are disposed in crescents shown in cross-section in FIG. 2 that are defined by the portions of two circles centered at points 16 and 18 that are not common to both of the circles. Referring again to FIG. 2, the dipole configuration is maintained by causing the current in portions 20 and 22 to flow in the same direction. That direction is opposite to the direction of the flow of current in portions 24 and 26. The uniform magnetic field indicated by flux arrow 12 of FIG. 2 is maintained throughout the circle defined by tube 28 which has a smaller outer diameter than the circles defining the boundaries of wires 14. To maintain the shape of the region containing wires 14, four identical filler pieces 30 fill the space between the outside of tube 28 and the circle bounding the inside of the region including wires 14. Two spacers 32 serve to maintain the separation of the filler pieces 30 from one another. Referring again to FIG. 1, the filler pieces 30 and spacers 32, which are hidden in FIG. 1 by wires 14, span not only the length of region 10 but also continue through regions 36 and 38 that define the ends of the superconducting magnet of the present invention. Spacers 34 separate the two symmetrical halves of the magnet, wound thus for ease of assembly about tube 28. Filler pieces 30 and spacers 32 may be modified in regions 36 and 38 in a way that will be made clear later.

The placement of wire in the nonintersecting portion of two overlapping circles, as illustrated in FIG. 2, is well known to provide a highly uniform dipole field in the intersecting portion of the circles defining placement of the wire and hence, in FIG. 2, within tube 28. A problem in the construction of dipole magnets and particularly of superconducting dipole magnets is to maintain the uniformity of magnetic fields across a cross section of the dipole magnet at the ends where the magnetic field is being reduced as a function of distance from its maximum value to zero. The reduction is accomplished in regions 36 and 38 of FIG. 1 by successively terminating an increasing fraction of the number of wires, all of which have run parallel to the axis of tube 28. Thus, in FIG. 1, the termination has taken place in five steps. One-fifth of the wires 14 loop to make a return path in loop 40*a*. Another fifth turns to begin a return path in loop 42*a;* a third fifth, in loop 44*a;* another fifth, in loop 46*a;* and the final fifth, in loop 48*a*. Adjacent loops are separated by spacers as shown. Thus, spacer 50*a* separates loops 40*a* and 42*a;* spacer 52*a* separates loops 42*a* and 44*a;* spacer 54*a*, loops 44*a* and 46*a;* and spacer 56*a*, loops 46*a* and 48*a*. Identical arrangements of loops and spacers are seen in FIGS. 1 and 2 to complete windings in region 36 opposite to loops 40*a* through 48*a* and spacers 50*a* through 56*a* in similar components correspondingly numbered with an appended *c*. Region 38 includes an arrangement exhibiting mirrored symmetry to terminate the other end of the superconducting dipole magnet, with corresponding components labeled similarly and having appended letters *b* and *d*.

The objective in terminating the superconducting dipole magnet at either of its ends can be stated in two ways. In terms of the magnetic field of the dipole magnet, the objective is to maintain maximum uniformity of the magnetic field across a cross-section area of the dipole while simultaneously maintaining a uniform fall-off of magnetic field to zero as a function of distance traversed along the axis of the magnet. In terms of structure of the magnet, this is attained by approximating a continuous reduction of the cross-sectional area of wires 14 as seen in FIG. 2 while simultaneously maintaining the remaining wires within a cross section defined by two overlapping circles.

There are several ways to accomplish this. Referring to FIG. 2, one way is to move points 16 and 18 closer together upon approaching the end until points 16 and 18 coincide at the center of tube 28. Since the radius of each of the overlapping circles is set by making a circle tangent to the outside of tube 28, it follows that each filler piece 30 would vary in cross-section as it extended successively past spacers 50, 52, 54, and 56 of FIG. 1. The variations in cross-section produce a constructional complication that can be avoided by causing the filler pieces 30 to have the same cross-section all along their length. This in turn means that the portions of wires 14 closest to tube 28 are always bounded by a portion of inner circle 60. Reducing the cross-sectional area to zero can then be done by moving the center 18 of the outer bounding circle 62 into coincidence with the fixed center of the inner bounding circle 16. It is immaterial whether the bounding circles 60 and 62 pass into coincidence with their joint center at the center of tube 28 or at another location. The design considerations are to reduce the area of wire to zero while keeping the remaining amount of wire in a region bounded symmetrically in cross-section by portions of two circles of equal area.

Figure 4:
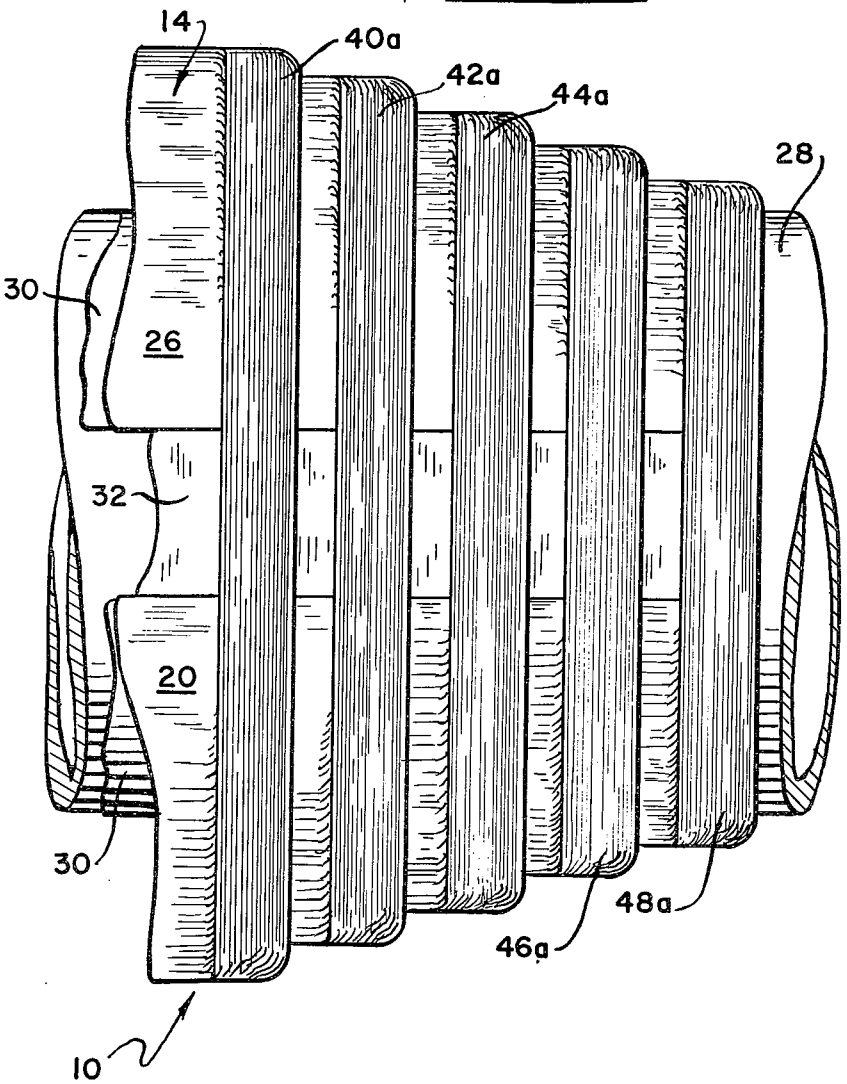
FIG. 4 is a top view of the end of the magnet of FIG. 1 as seen along lines 4—4 of FIG. 1.
Figure 2:
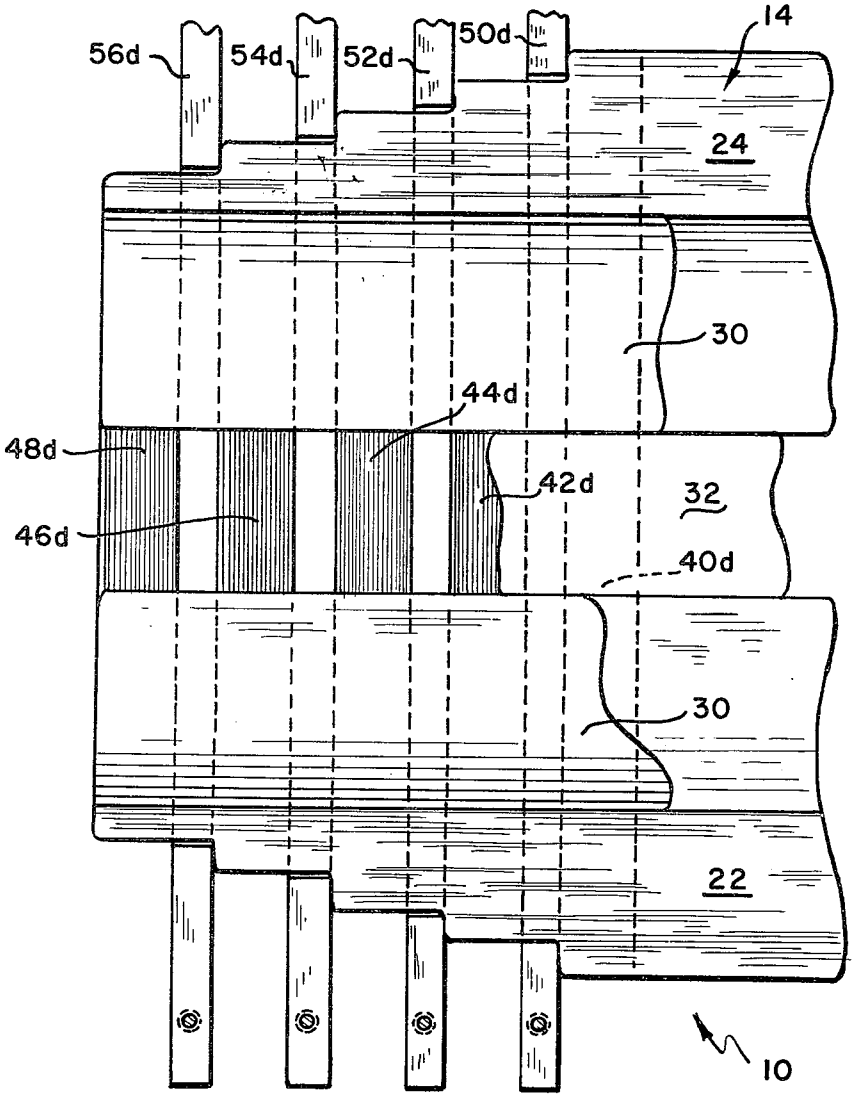

Further illustration of the terminating portions of the magnet is afforded by FIGS. 3 and 4. FIG. 3 is a partial sectional side view of an end of the magnet, taken along section lines 3—3 of FIG. 1, with tube 28 removed. FIG. 4 is a top view of an end of the magnet as seen along line 4—4 of FIG. 1. Spacers 50*a*, 52*a*, 54*a*, and 56*a* are removed in FIG. 4 to increase clarity. Referring to FIG. 3, wires 14 are seen to fill an increasingly smaller area as a function successively of distance past spacers 50*d*, 52*d*, 54*d*, and 56*d*. FIG. 4 shows that the reductions in area are accomplished by successively passing some of the wires 14 to reversed directions through loops 40*a*, 42*a*, 44*a*, 46*a*, and 48*a*. A bottom spacer 32, visible in section in FIG. 2, is seen from inside the magnet in FIG. 3 and a corresponding top spacer 32 is seen from outside in FIG. 4. Filler pieces 30 extend the length of the magnet to provide portions of cylindrical surfaces against which wires 14 are wound in the following steps. Starting at the left end of FIG. 1, a wire of a superconducting material such as niobium, a niobium-titanium alloy, or the like, embedded in copper and insulated, is passed along tube 28 to the right of spacer 56*a*. The wire passes as part of loop 48*a*, then along tube 28 past spacer 56*b*, over as part of loop 48*b*, along tube 28 past spacer 54*a*, over as part of loop 46*a*, along tube 28 past spacer 54*b*, over as part of loop 46*b*, along tube 28 past spacer 52*a*, over as part of loop 44*a*, along tube 28 past spacer 52*b*, over as part of loop 44*b*, along tube 28 past spacer 50*a*, over as part of loop 42*a*, along tube 28 past spacer 50*b*, over as part of loop 42*b*, along tube 28 to but not past spacer 50*a*, over as part of loop 40*a*, along tube 28 to but not past spacer 50*b*, and over as a part of loop 40*b*. This completes half a winding sequence. The other half is completed by continuing in reverse order through loops 40, 42, 44, 46, and 48 to return to the starting point. The full sequence is repeated a predetermined number of times to produce half a dipole magnet of the desired field strength. The other half is wound by the identical process. It has been found helpful to wind alternate full sequences or alternate equal numbers of full sequences in opposite directions, making appropriate electrical connections when changing winding directions, to minimize tendencies of the wires to warp. The wound structure is potted in an epoxy or other conventional potting compound to produce a finished half of a dipole magnet.

A better understanding of the ends of the magnet as obtained by the winding process described above is afforded by FIGS. 5*a*–5*e*, which comprise a sequence of sectional views of the magnet of FIG. 1, taken along section lines 5*a*—5*a* through 5*3*—5*e* of FIG. 1. These views represent successive reductions of the area of wire decreasing from the full amount of FIG. 2 to no wire past the end of the magnet. Referring to FIG. 2, wire 14 is there included in portions 20, 22, 24, and 26 of circles that are centered at points 16 and 18. FIG. 5*a* repeats for clarity the view of FIG. 2. The area of superconducting wire has undergone one reduction in FIG. 5*a* as a result of moving the outer bounding circles to points 66*b* and 68*b.* This has been accomplished by looping one-fifth of the wire over loop 40*a.* The remaining wire is in portion 70*a,* 72*a,* 74*a,* and 76*a* of the area bounded by circles. A further reduction in area is achieved by taking a second fifth of the wire over loop 42*a,* leaving in FIG. 5*c* a number of smaller portion 70*b,* 72*b,* 74*b,* and 76*b* of wire, bounded by circles centered at points 16, 18, and the center. Further reductions are accomplished in the same way in FIGS. 5*d* and 5*e,* so that in FIG. 5*e* the outsides of bounding circles are centered at points 66*c* and 68*c.* Comparison of FIG. 5*e* with FIG. 5*a* shows that points 68*c* is close to point 16 and that point 66*c* is close to point 18. The end of the magnet is achieved when those points merge, leaving no area for wire.

Figure 6:
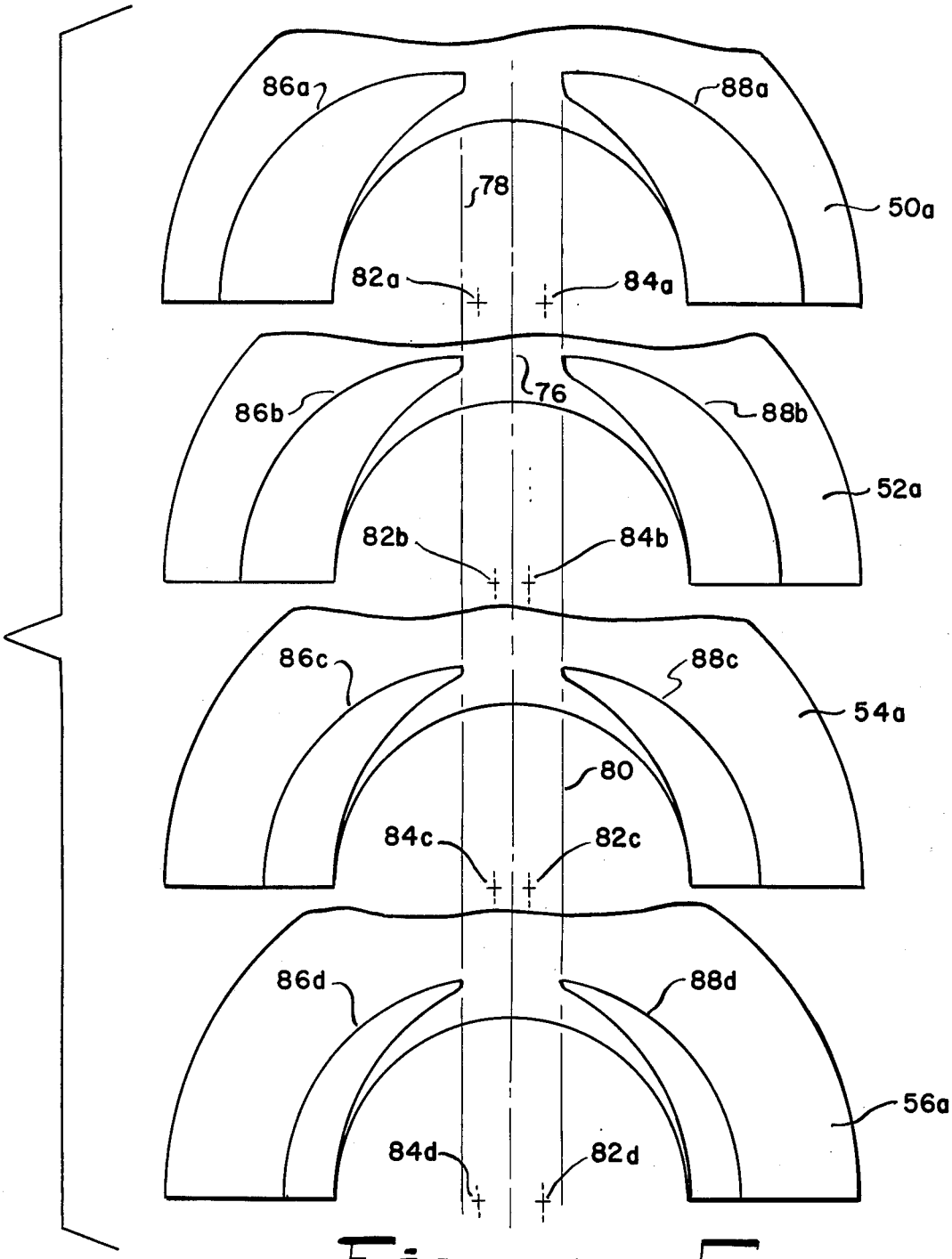
FIG. 6 is a set of end views of the spacers of FIG. 1.

FIG. 6 is a set of views of the spacers 50*a,* 52*a,* 54*a,* and 56*a* of FIG. 1. Spacers 50*a,* 52*a,* 54*a,* and 56*a* are seen from FIG. 1 to proceed in sequence in a direction away from the center of the magnet and toward the ends. Each of the spacers 50*a,* 52*a,* 54*a,* and 56*a* is bounded by a circle centered on line 76 of FIG. 6. Lines 78 and 80 connect the successive locations of the centers of circles that wire shown in FIG. 2 to be located at points 16 and 18. Those points 16 and 18 also defined the locations of circles limiting the extent radially inward of the wire of the dipole magnet. Arcs of circles defining the inside portions of spacers 50*a,* 52*a,* 54*a,* and 56*a* are constructed by placing the centers of circles of equal radius successively at points 82*a,* 82*b,* 82*c,* and 82*d* for one set of bounding arcs and at points 84*a,* 84*b,* 84*c,* and 84*d* for the other set of bounding arcs. From an examination of spacers 50*a,* 52*a,* 54*a, and* 56*a* of FIG. 6 it can be seen that in progressing toward the end of the magnet the area available for winding wire continues to be bounded by an arc of a circle, specifically, arcs 86*a, b, c* and *d,* centered at points 82*a, b, c* and *d* and arcs 88*a, b, c* and *d,* centered respecively at points 84*a, b, c* and *d.* It should be evident from an inspection of FIG. 1 that the spacers of FIG. 6 represent one set of the four sets of spacers 50, 52, 54, and 56 of FIG. 1 and that the resulting spacers contribute to the placement of the windings by defining areas for winding that are bounded by circles, the centers of which move increasingly close together as the winding proceeds toward the ends of the magnet. The spacers 50, 52, 54, and 56 thus carry out two functions. First, they define the lateral extent of a portion of the wires forming the superconducting dipole magnet. Thus, as described earlier, one-fifth of the wires form a loop 40 before reaching spacer 50. A second fifth forms a loop 42 after passing spacer 50. A third fifth forms a loop 44 after passing spacer 52. Another fifth forms a loop 46 after passing spacer 54 and the final fifth forms a loop 48 after passing spacer 56. At or near each of the spacers 50-56 a portion of the dipole is thus terminated and the associated dipole magnetic field is reduced by the termination of that portion of the wire. A second function served by the spacers 50, 52, 54, and 56 is to provide a size and shape to the region through which wires are permitted to pass to define the steadily reducing area of wire at the ends of the magnet. This is seen in FIG. 6 as described above by the fact that the bounding circles of the spacers 50–56 are produced from centers that move sequentially together in passing from one spacer to the next.

A superconducting dipole magnet according to the present invention has been build at the Argonne National Laboratory. The superconducting material was niobium-titanium, with 402 filaments of superconductor embedded in copper in each wire to provide a 3:1 ratio of copper area to superconductor area. This is a commercially obtained product. The wound magnet, containing 1300 wires in each portion 20, 22, 24, and 26 of FIG. 2, was wrapped with flattened aluminum wire, wound under tension. It was operated 4 K, the temperature of liquid helium. With the wires forming a single series circuit carrying a current of 192 A, the magnet produced a magnetic flux density of 3.5 Tesla with a linearity within 0.1 % across a circular cross-section having a diameter of 3.5 (8.9 cm).

The embodiments of the invention in which an exlusive property or privilege is claimed are defined as follows:

1. A superconducting dipole electromagnet wound of wires formed by a filament of superconducting material embedded in a normal conductor that is enclosed in an electrically insulating material, the electromagnet exhibiting cylindrical symmetry about an axis, the electromagnet comprising:

a. a central portion of said wires disposed substantially parallel to each other and to the axis of cylindrical symmetry, the wires in said central portion disposed in two crescent-shaped cross-sections defined by non-intersecting portions of two equal circles having centers on a line through the axis and perpendicular to the axis, the centers equidistant from the axis, the wires in one of said two crescent-shaped cross-sections disposed to carry electric current in a first direction parallel to the axis and the wires in the other of said two crescent-shaped cross-sections carrying electric current in an opposite direction;

b. a first terminating portion of said wires connected electrically to the central portion at a first end to form a plurality of looping portions, each of said looping portions connecting wires from one of said crescent-shaped cross-sections to wires in the other of said crescent-shaped portions and continuing an electric circuit therethrough, the fractional number of wires in each of said looping portions equalling the reciprocal of the number of said plurality, further unlooped portions of said wires disposed in cross-sections bounded by arcs of two bounding circles equal in size to said two equal circles, the centers of the bounding circles moving into coincidence upon approaching an end of the magnet; and c. a second terminating portion of said wires connected to the central portion at a second end opposite to said first end and exhibiting mirrored symmetry to said first terminating portion, the second terminating portion carrying electric current connected to continue an electric circuit from wires in one of said crescent-shaped cross-sections to wires in the other, whereby the second terminating portion forms with the first terminating portion and the central portion a continuous current-carrying dipole electromagnet.

2. The electromagnet of claim 1 wherein the looping portions of each adjacent pair of looping portions are separated by nonmagnetic spacers bounded on the inside by arcs equal to the arcs of the bounding circles of the unlooped wires.

3. A dipole electromagnet for generating a magnetic field perpendicular to an axis of cylindrical symmetry of the electromagnet comprising:

a central portion of superconducting wires disposed substantially parallel to the axis in two crescent-shaped cross-sections formed by the nonintersecting portions of two overlapping circles of equal area;

a first end region connected to the central portion at a first end thereof, the first end region comprising a plurality of bundles of approximately equal numbers of looping superconducting wires, each of the looping wires disposed in a plane substantially perpendicular to the axis of the dipole electromagnet and connecting a wire in one of said two crescent-shaped cross-sections to a wire in the other of said two crescent-shaped cross-sections to form with said wires a portion of an electric circuit; and a second end region connected to the central region at a second end view thereof, the second end region symmetrically identical to the first end region and forming therewith an electrical interconnection for carrying current through said wires, whereby the interconnection of the central portion and the first and second end regions forms a dipole electromagnet.

4. The apparatus of claim 3 comprising in addition a plurality of nonmagnetic spacers, one of each of said spacers disposed between two adjacent bundles of looping wires, each of said spacers being a disc extending beyond said bundles of looping wires and cut with a circular radius to pass nonlooping wires parallel to the axis of the electromagnet.

5. The apparatus of claim 3 wherein the superconducting wires are niobium-titanium embedded in copper.

* * * * *